US009660353B2

(12) United States Patent
Wu et al.

(10) Patent No.: US 9,660,353 B2
(45) Date of Patent: May 23, 2017

(54) SMALL-SIZED ELASTIC INNER CONDUCTOR RIGHT-ANGLED ELBOW CONDUCTOR CONNECTOR

(71) Applicant: CommScope Technologies LLC, Hickory, NC (US)

(72) Inventors: JianPing Wu, Zhenjiang (CN); Yujun Zhang, Suzhou (CN); Huifang Zhou, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/918,083

(22) Filed: Oct. 20, 2015

(65) Prior Publication Data

US 2016/0111798 A1 Apr. 21, 2016

(30) Foreign Application Priority Data

Oct. 21, 2014 (CN) ..... 2014 2 0610790 U

(51) Int. Cl.

| | |
|---|---|
| ***H01R 4/18*** | (2006.01) |
| ***H01R 4/28*** | (2006.01) |
| *H01R 24/38* | (2011.01) |
| *H01R 9/05* | (2006.01) |
| *H01R 103/00* | (2006.01) |
| *H01R 24/54* | (2011.01) |
| *H01R 101/00* | (2006.01) |

(52) U.S. Cl.

CPC ..... *H01R 4/183* (2013.01); *H01R 4/28* (2013.01); *H01R 24/545* (2013.01); *H01R 9/05* (2013.01); *H01R 9/0518* (2013.01); *H01R 24/38* (2013.01); *H01R 24/54* (2013.01); *H01R 2101/00* (2013.01); *H01R 2103/00* (2013.01)

(58) Field of Classification Search

CPC H01R 2103/00; H01R 9/0518; H01R 24/545; H01R 24/54; H01R 24/38; H01R 9/05

USPC ..... 439/582

See application file for complete search history.

(56) References Cited

U.S. PATENT DOCUMENTS

2003/0224658 A1* 12/2003 Koch ..... H01R 9/0518 439/582

* cited by examiner

*Primary Examiner* — Abdullah Riyami
*Assistant Examiner* — Justin Kratt
(74) *Attorney, Agent, or Firm* — Myers Bigel, P.A.

(57) ABSTRACT

A small-sized elastic inner conductor right-angled elbow conductor connector includes: a first conductor capable of deforming elastically, the first conductor having a first axis, the first conductor deforms elastically and springs back in a longitudinal direction perpendicular to the first axis under the action of a second conductor, thereby elastically contacting the second conductor arranged perpendicular to the first axis and retaining the second conductor, when the second conductor is connected with the first conductor, such that the first conductor and the second conductor are able to be connected to each other at a right angle.

11 Claims, 5 Drawing Sheets

SMALL-SIZED ELASTIC INNER CONDUCTOR RIGHT-ANGLED ELBOW CONDUCTOR CONNECTOR

TECHNICAL FIELD

The utility model generally relates to a conductor connector, and in particular to a small-sized elastic inner conductor right-angled elbow conductor connector.

BACKGROUND

The conductor connector of the utility model is configured to electrically connect the first and second conductor parts, such that a reliable electrical connection is obtained between the two conductor parts. For example, the conductor connection can be applied to printed circuit boards or used for cable connectors for communication signal transmission.

The cable connectors include straight connectors and right-angled elbow conductor connectors, wherein the right-angled elbow conductor connectors have found wide applications in high-frequency RF signal transmission, because they can save installation space, and at the same time make wiring more reasonable and aesthetic. However, most of the regular small-sized right-angled elbow conductor connectors adopt such a connection manner wherein the outer conductor is crimped and the inner conductor is welded, thus the cost would be substantially higher than the straight connectors. As known by those skilled in the art, the "small-sized" connectors are used for the cables of which the inner diameter of the outer conductor is no more than 3 mm.

SUMMARY

An object of the utility model is to provide a low-cost small-sized, direct-inserting conductor right-angled elbow conductor connector, which is easy to be installed and is able to be reliably connected with an inner conductor of a cable, and is suitable for mass production.

According to the utility model, there is provided a small-sized elastic inner conductor right-angled elbow conductor connector, wherein the small-sized elastic inner conductor right-angled elbow conductor connector comprises a first conductor capable of deforming elastically, the first conductor having a first axis, the first conductor deforms elastically and springs back in a longitudinal direction perpendicular to the first axis under the action of a second conductor, thereby elastically contacts the second conductor arranged perpendicular to the first axis and retains the second conductor, when the second conductor is connected with the first conductor, such that the first conductor and the second conductor are able to be connected to each other at a right angle.

An inner conductor of the small-sized right-angled elbow conductor connector has an auxiliary hole for dispersing stress and a function hole for grasping and connecting the inner conductor of the cable, which holes are distributed in parallel.

Preferably, the first conductor has a hollow portion, the hollow portion has at least two bending ribs and a hollow space between the at least two bending ribs, the hollow portion is connected with the remaining portions of the first conductor body through the at least two bending ribs, and an outer periphery of the at least two bending ribs defines a maximum radial dimension in a plane perpendicular to the first axis.

The second conductor has a hole, a diameter of the hole is smaller than the maximum radial dimension, such that the at least two bending ribs deform elastically when the hollow portion of the first conductor is inserted in the hole of the second conductor, and the first conductor is elastically retained in the second conductor by virtue of the elasticity of the material itself.

Preferably, the small-sized elastic inner conductor right-angled elbow conductor connector comprises a first leg and a second leg arranged angularly to the first leg, the first conductor is arranged in the first leg, the first leg, the second leg and conductors are each made of a conductive material, and an insulator is disposed between an inner wall of the first leg and the first conductor.

Preferably, the first conductor has a first hole at an end connected to the second conductor, an axis of the first hole is perpendicular to the first axis, the second conductor is able to be inserted in the first hole in parallel with the axis of the first hole, and a first slot is slotted at a free end of the first conductor along the first axis, the first slot is communicated with the first hole, thereby the end of the first conductor is divided into a first half and a second half.

Preferably, the first conductor also has a second slot disposed along the first axis, and the second slot is also communicated with the first hole and diametrically opposite to the first slot.

Preferably, a second hole is arranged at the other end of the second slot opposite to the end where the second slot is communicated with the first hole, an axis of the second hole is parallel with the axis of the first hole.

Preferably, a diameter of the second hole is larger than a width of the second slot and smaller than the diameter of the first hole.

Preferably, the diameter of the second hole is equal to the width of the second slot.

Preferably, the diameter of the first hole is smaller than a diameter of the second conductor, and the first slot is aequilate along a first axial direction.

Preferably, the widths of the first slot and the second slot taper towards the free end of the first conductor.

Preferably, the second conductor is an inner conductor of a cable, and the second leg is also provided with a connecting device for connecting with an outer conductor of the cable.

Preferably, the small-sized elastic inner conductor right-angled elbow conductor connector also comprises a cylindrical part cooperating with the second leg, the connecting device is convex teeth disposed on the second leg, and the outer conductor of the cable is crimped between the convex teeth and an inner surface of the cylindrical part.

Preferably, the first leg is provided with an envelop cover, the envelop cover covers an end of the first leg.

The aforementioned small-sized elastic inner conductor right-angled elbow conductor connector utilizes an additional auxiliary hole which can disperse stress to improve the elasticity of the material and achieve a convenient and reliable connection between the two conductors, and the connector itself is simple in structure and is suitable for mass production.

BRIEF DESCRIPTION OF THE DRAWINGS

Other features and advantages of the utility model will become more apparent from the description of various embodiments of the utility model which are shown in the drawings by way of non-limited examples, wherein.

| Reference Signs | | | |
|---|---|---|---|
| 1 | small-sized right-angled elbow conductor connector | | |
| 2 | first leg | | |
| 3 | second leg | 4 | cylindrical part |
| 5 | first conductor | 6 | second conductor |
| 7 | cable | 8 | first hole |
| 9 | second hole | 10 | first slot |
| 11 | first half | 12 | second half |
| 13 | second slot | 14 | end cap |
| 15 | first conductor | 16 | second conductor |
| 17 | hollow portion | 18 | bending rib |
| 19 | bending rib | 20 | hollow space |
| 21 | hole | | |

DETAILED DESCRIPTION

Figure 1:
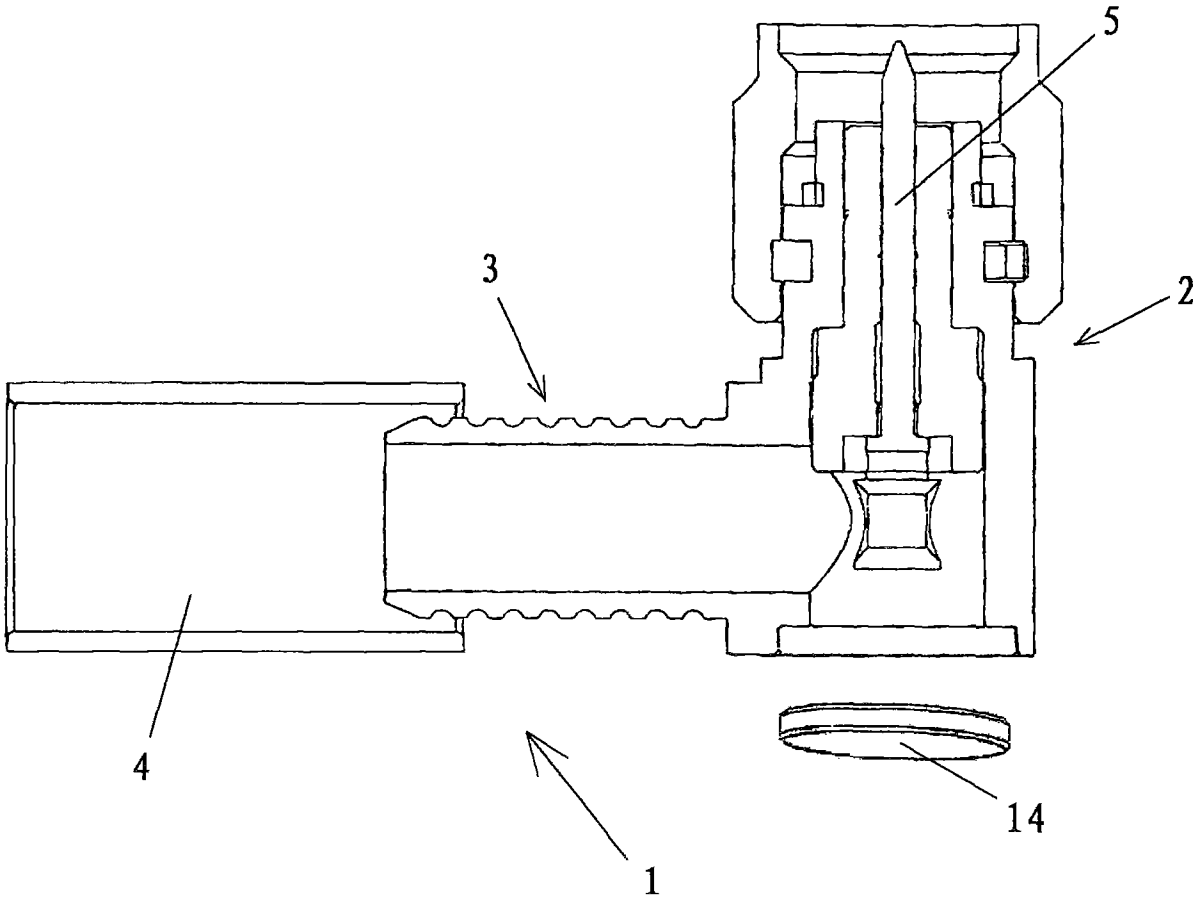
FIG. 1 shows a first embodiment of a small-sized elastic inner conductor right-angled elbow conductor connector.

Referring to FIG. 1, a small-sized right-angled elbow conductor connector 1 for high-frequency RF signal transmission is shown. The right-angled elbow conductor connector 1 comprises: a right-angled shell body, the body comprising a first leg 2 of the right angle, a second leg 3 perpendicular to the first leg 2 and a cylindrical part 4 mounted on the second leg 3, the cylindrical part 4 is made of a conductive material, for example a brass; a first conductor 5 mounted in the first leg 2 of the right-angled shell body, the first conductor 5 is made of a conductive material, for example a brass; and an end cap 14, for enveloping an end of the first leg 2. The first leg 2 and the second leg 3 are each made of a conductive material (for example a brass) and can he formed integrally or assembled from two parts. The second leg 3 and the cylindrical part 4 arc mounted by crimping, thereby they can connected with an outer conductor of a cable. For example, the second leg 3 has outer convex teeth 21, and the outer conductor of the cable 7 (see FIG. 3, 4) is crimped between the cooperating inner side of the cylindrical part 4 and the convex teeth 21 on the second leg 3, such that the outer conductor of the cable and the second leg of the connector are reliably connected. An inner conductor of the cable 7 or a second conductor 6 (see FIG. 3, 4) is inserted in the first conductor 5, such that the inner conductor of the cable and the inner conductor of the connector are reliably connected, as will be described in detail hereinbelow. An insulator is arranged between the first conductor 5 and an inner wall of the first leg 2.

Figure 2:
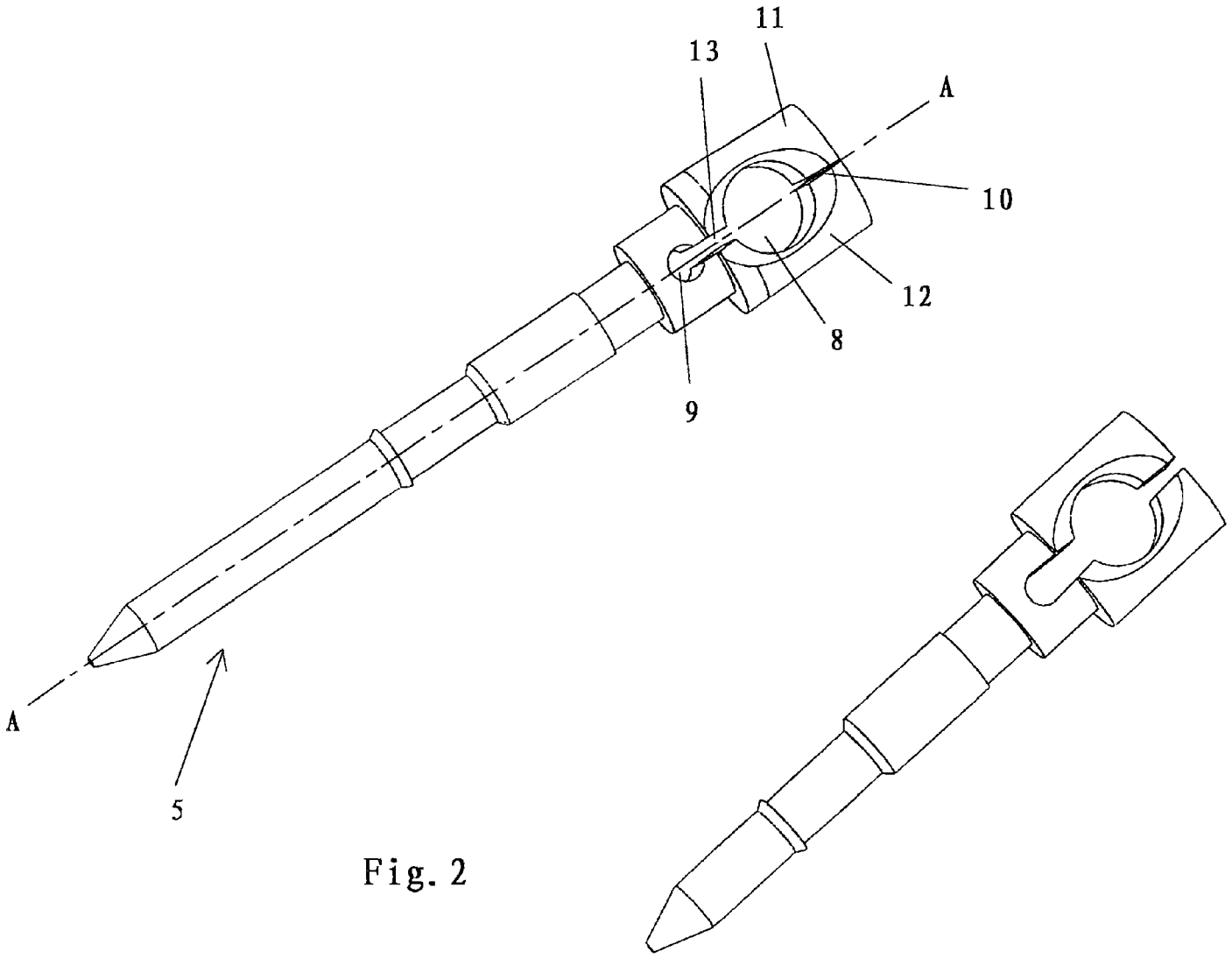
FIG. 2 shows a first conductor of the small-sized elastic inner conductor right-angled elbow conductor connector in FIG. 1.

Referring to FIG. 2, a perspective view of the first conductor 5 of the right-angled elbow conductor connector 1 is shown. The elongate first conductor 5 has a longitudinal axis A and the first conductor 5 at an end thereof has a first hole 8 with an axis perpendicular to the axis A, such that the second conductor 6 is able to be inserted in the first hole 8 perpendicular to the axis A. A first slot 10 is slotted at this end of the first conductor 5 along the axis A, and the first slot 10 is communicated with the first hole 8, such that this end of the first conductor is divided into a first half 11 and a second half 12, so as to be able to elastically clamp the second conductor 6 when the second conductor 6 is inserted in it. The first hole 8 is a function hole for clamping.

Still referring to FIG. 2, the first conductor 5 also has a second slot 13 disposed along the axis A, and the second slot 13 is also communicated with the first hole 8 and is positioned on a side of the first hole 8 diametrically opposite to the first slot 10. A second hole 9 is arranged at the other end of the second slot 13 opposite to the end where the second slot is communicated with the first hole 8, the axis of the second hole 9 is parallel with the axis of the first hole 8, and a diameter of the second hole is larger than a width of the second slot 13 but smaller than the diameter of the first hole 8, as shown in the left one in FIG. 2. It can also be envisioned that the diameter of the second hole 9 is equal to or even larger than the diameter of the first hole. The second hole 9 is an auxiliary hole, the function of which will be described hereinbelow.

As an alternative, the diameter of the second hole 9 may be equal to the width of the second slot 13, as shown in the right one in FIG. 2.

The diameter of the first hole 8 may be smaller than a diameter of the second conductor 6, and the slot 10 is aequilate along the axis A-A, thus the first slot 10 is able to be spreaded out when the second conductor 6 is inserted in the first hole 8, and then elastically clamps the second conductor 6 between the first half 11 and the second half 12 by virtue of the elasticity of the material itself. Alternatively, the diameter of the first hole 8 is equal to or even larger than the diameter of the second conductor 6, and the first half 11 and the second half 12 are squeezed with a tool (for example a press or a molding tool) after the first slot 10 is slotted, then after aging treatment, the first conductor plastically deforms at the base of the second hole 9, thus the widths of the first slot 10 and the second slot 13 taper towards the end of the first conductor, and the diameter of the first hole 8 becomes smaller, thereby a great elastic force for clamping the second conductor 6 is obtained.

Figure 3:
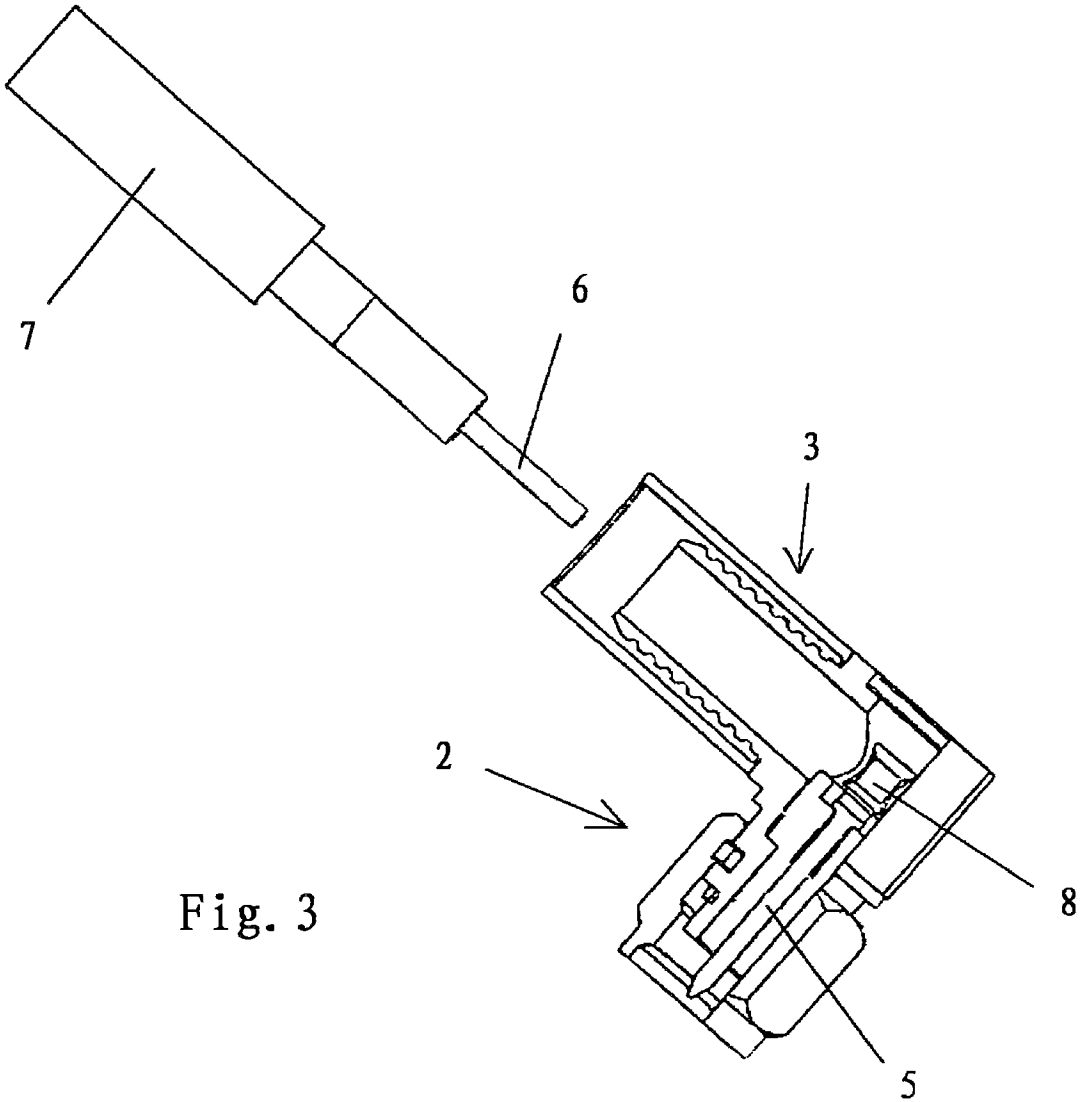
FIG. 3 and FIG. 4 show a process in which a second conductor and the first conductor are connected.
Figure 4:
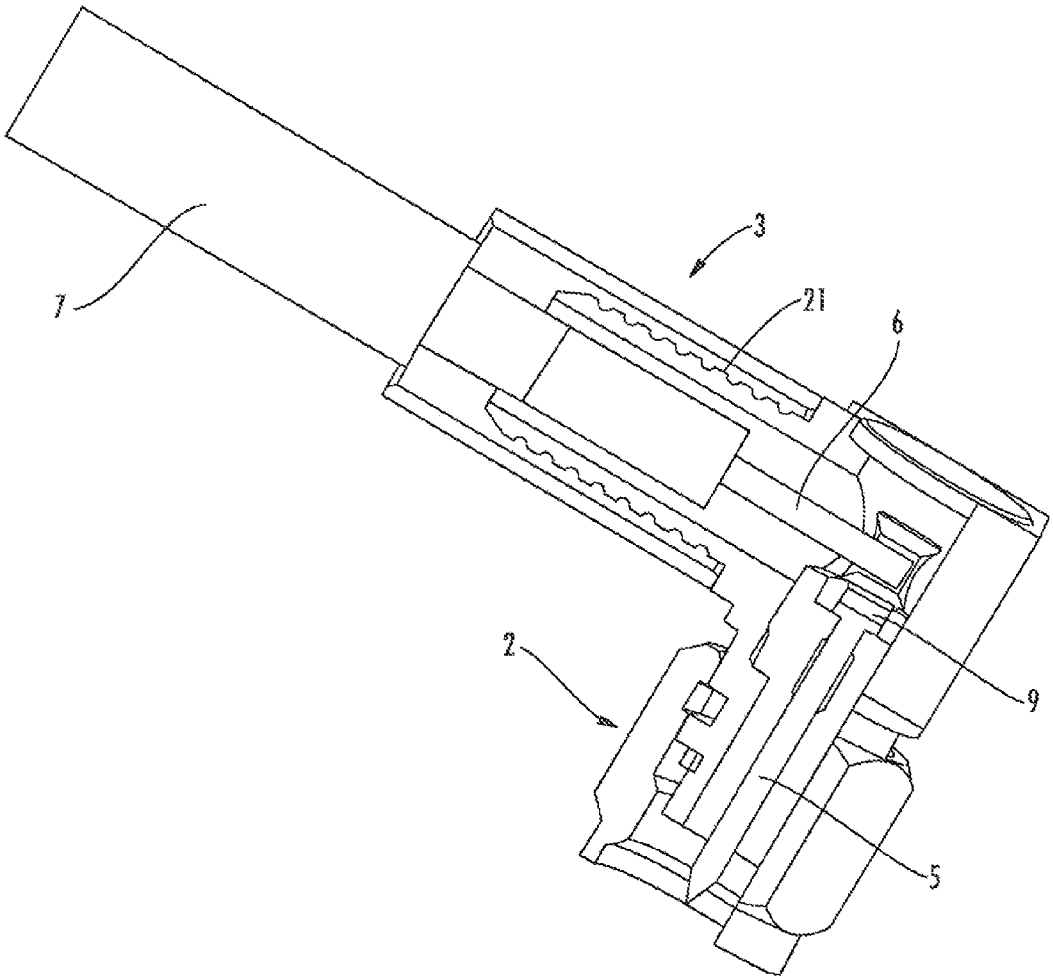

Next the insertion process of the inner conductor 6 of the cable 7 is illustrated with reference to FIGS. 3 and 4. As shown in FIG. 3, the cable 7 comprises the inner conductor 6, the inner conductor 6 is inserted in the second leg 3 along a direction perpendicular to the axis A, aligned with the first hole 8 at the end of the first conductor 5 in the first leg 2, and then is inserted in the first hole 8, when the right-angled elbow conductor connector of the utility model is connected with the cable 7, as shown in FIG. 3. Thus, the slot 10 is spread out slightly and then elastically springs back because of the property of the material itself, thus the inner conductor 6 is elastically clamped between the first half 11 and the second half 12, such that the inner conductor 6 and the first conductor 5 are reliably electrically connected. Due to the presence of the second hole 9, a stress concentration caused by the insertion of the second conductor 6 is avoided, meanwhile the inner conductor 6 can be inserted in the first hole 8 quite easily, and the elastic clamping force for the inner conductor is improved.

The right-angled elbow conductor connector of the utility model has an auxiliary hole for dispersing stress and a function hole for grasping and connecting the inner conductor of the cable, which holes are arranged in parallel. The double-hole right-angled elbow conductor connector is particularly suitable for connecting the small-sized cables, for example the Cinta series cables produced by CommScope Corp.

Next a second embodiment of the right-angled elbow conductor connector will be described with reference to FIG. 5 and FIG. 6.

Figure 5:
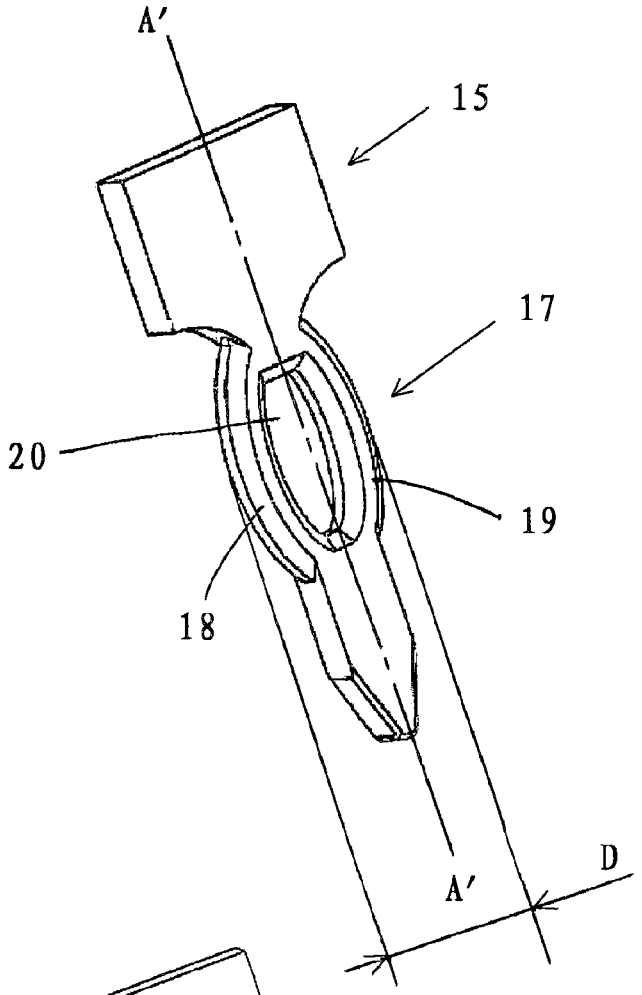
FIG. 5 shows a second embodiment of the small-sized elastic inner conductor right-angled elbow conductor connector.
Figure 6:
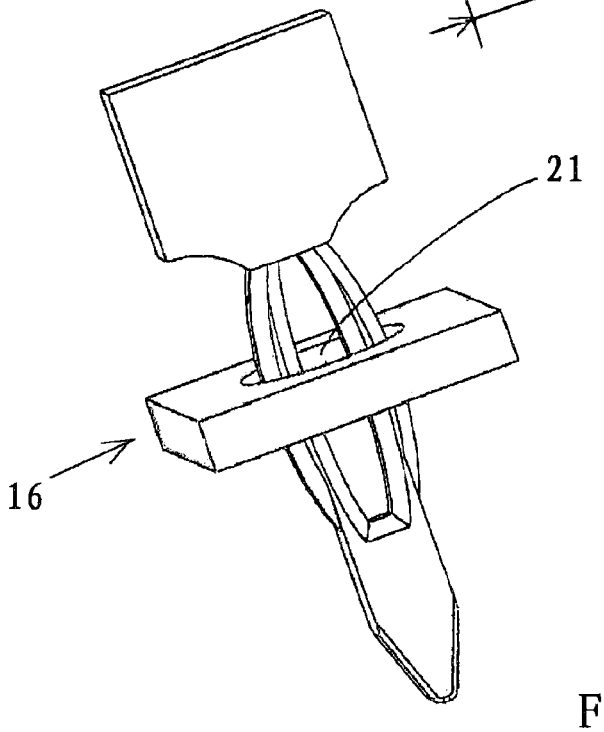
FIG. 6 shows the connection between a first conductor and a second conductor in the second embodiment.

Referring to FIG. 5, a elongate first conductor 15 having an axis A' is made of a conductive material, and has a hollow portion 17, the hollow portion 17 has at least two bending ribs 18, 19 and a hollow space 20 between the two bending ribs, the hollow portion 17 is connected with remaining portions of the first conductor body 15 through the at least two bending ribs 18, 19, and an outer periphery of the at least two bending ribs defines a maximum radial dimension D in a plane perpendicular to the axis A'.

A second conductor 16 has a hole 21, a diameter of the hole 21 is slightly smaller than the maximum radial dimension D, such that the bending ribs 18, 19 deform elastically when the hollow portion 17 of the first conductor 15 is inserted in the hole 21 of the second conductor, and the first conductor 15 is elastically retained in the second conductor 16 by virtue of the elasticity of the material itself, thereby the reliable electrical connection between the first conductor 15 and the second conductor 16 is achieved.

In addition, although the particular features of the utility model have been described with respect to only one or more of several exemplary embodiments, such features can be combined with one or more features of other embodiments, if such features are desirable or advantageous for any given or particular application.

The invention claimed is:

1. A small-sized elastic inner conductor right-angled elbow conductor connector, comprising: a first conductor capable of deforming elastically, the first conductor having a first axis, the first conductor deforms elastically and springs back in a longitudinal direction perpendicular to the first axis under the action of a second conductor, thereby elastically contacting the second conductor arranged perpendicular to the first axis and retaining the second conductor when the second conductor is connected with the first conductor, such that the first conductor and the second conductor are able to be connected to each other at a right angle;

wherein the small-sized elastic inner conductor right-angled elbow conductor connector comprises a first leg and a second leg arranged angularly to the first leg, the first conductor is arranged in the first leg, the first leg, the second leg and conductors are each made of a conductive material, and an insulator is disposed between an inner wall of the first leg and the first conductor;

wherein the second conductor is an inner conductor of a cable, and the second leg is also provided with a connecting device for connecting with an outer conductor of the cable; and wherein the small-sized elastic inner conductor right-angled elbow conductor connector also comprises a cylindrical part cooperating with the second leg, the connecting device is convex teeth disposed on the second leg, and the outer conductor of the cable is crimped between the convex teeth and an inner surface of the cylindrical part.

2. The small-sized elastic inner conductor right-angled elbow conductor connector according to claim 1, wherein the first leg is provided with an envelope cover, and the envelope cover covers an end of the first leg.

3. The small-sized elastic inner conductor right-angled elbow conductor connector according to claim 1, wherein the first conductor has a first hole at an end connected to the second conductor, an axis of the first hole is perpendicular to the first axis, the second conductor is able to be inserted in the first hole in parallel with the axis of the first hole, and a first slot is slotted at a free end of the first conductor along the first axis, the first slot is communicated with the first hole, thereby the end of the first conductor is divided into a first half and a second half.

4. The small-sized elastic inner conductor right-angled elbow conductor connector according to claim 3, wherein the first conductor also has a second slot disposed along the first axis, and the second slot is also communicated with the first hole and diametrically opposite to the first slot.

5. The small-sized elastic inner conductor right-angled elbow conductor connector according to claim 4, wherein a second hole is arranged at the other end of the second slot opposite to the end where the second slot is communicated with the first hole, an axis of the second hole is parallel with the axis of the first hole.

6. The small-sized elastic inner conductor right-angled elbow conductor connector according to claim 5, wherein the diameter of the second hole is equal to the width of the second slot.

7. The small-sized elastic inner conductor right-angled elbow conductor connector according to claim 5, wherein a diameter of the second hole is larger than a width of the second slot and smaller than a diameter of the first hole.

8. The small-sized elastic inner conductor right-angled elbow conductor connector according to claim 7, wherein the diameter of the first hole is smaller than a diameter of the second conductor, and the first slot is of constant width along a first axial direction.

9. The small-sized elastic inner conductor right-angled elbow conductor connector according to claim 7, wherein the widths of the first slot and the second slot taper towards the free end of the first conductor.

10. A small-sized elastic inner conductor right-angled elbow conductor connector, comprising: a first conductor capable of deforming elastically, the first conductor having a first axis, the first conductor deforms elastically and springs back in a longitudinal direction perpendicular to the first axis under the action of a second conductor, thereby elastically contacting the second conductor arranged perpendicular to the first axis when the second conductor is connected with the first conductor, such that the first conductor and the second conductor are able to be connected to each other at a right angle;

wherein the first conductor has a hollow portion, the hollow portion has at least two bending ribs and a hollow space between the at least two bending ribs, the hollow portion is connected with the remaining portions of the first conductor through the at least two bending ribs, and an outer periphery of the at least two bending ribs defines a maximum radial dimension in a plane perpendicular to the first axis, the second conductor has a hole, a diameter of the hole is smaller than the maximum radial dimension, such that the at least two bending ribs deform elastically when the hollow portion of the first conductor is inserted in the hole of the second conductor, and the first conductor is elastically retained in the second conductor by virtue of the elasticity of the material itself.

11. A small-sized elastic inner conductor right-angled elbow conductor connector, comprising: a first conductor capable of deforming elastically, the first conductor having a first axis, the first conductor deforms elastically and springs back in a longitudinal direction perpendicular to the first axis under the action of a second conductor, thereby elastically contacting the second conductor arranged perpendicular, to the first axis and retaining the second conductor, when the second conductor is connected with the first conductor, such that the first conductor and the second conductor are able to be connected to each other at a right angle;

wherein the first conductor has a first hole at an end connected to the second conductor, an axis of the first hole is perpendicular to the first axis, the second conductor is able to be inserted in the first hole in parallel with the axis of the first hole, and a first slot is slotted at a free end of the first conductor along the first axis, the first slot is communicated with the first hole, thereby the end of the first conductor is divided into a first half and a second half;

wherein the first conductor also has a second slot disposed along the first axis, and the second slot is also communicated with the first hole and diametrically opposite to the first slot;

wherein a second hole is arranged at the other end of the second slot opposite to the end where the second slot is communicated with the first hole, an axis of the second hole is parallel with the axis of the first hole; and wherein a diameter of the second hole is larger than a width of the second slot and smaller than a diameter of the first hole.

* * * * *